US008546707B2

(12) United States Patent
Yorino

(10) Patent No.: US 8,546,707 B2
(45) Date of Patent: Oct. 1, 2013

(54) IN-VEHICLE INPUT DEVICE

(75) Inventor: Kazuya Yorino, Unterschleissheim (DE)

(73) Assignee: Alps Electric Co., Ltd., Tokyo (JP)

( * ) Notice: Subject to any disclaimer, the term of this patent is extended or adjusted under 35 U.S.C. 154(b) by 342 days.

(21) Appl. No.: 13/034,628

(22) Filed: Feb. 24, 2011

(65) Prior Publication Data

US 2011/0220480 A1 Sep. 15, 2011

(30) Foreign Application Priority Data

Mar. 10, 2010 (JP) ..... 2010-053396

(51) Int. Cl.
*H01H 9/26* (2006.01)

(52) U.S. Cl.
USPC ..... 200/5 A

(58) Field of Classification Search
USPC ..... 200/4, 5 R, 14, 17 R, 18, 61.54, 200/61.57; 341/20, 22, 35; 345/156, 157, 345/160, 161, 163, 168, 169, 184; 455/575.1
See application file for complete search history.

(56) References Cited

U.S. PATENT DOCUMENTS

| | | | | |
|---|---|---|---|---|
| 5,736,696 | A * | 4/1998 | Del Rosso | 200/5 R |
| 5,949,149 | A * | 9/1999 | Shitanaka et al. | 307/10.1 |
| 6,299,320 | B1 | 10/2001 | Kato et al. | |
| 6,388,221 | B1 * | 5/2002 | Rudolph et al. | 200/556 |
| 6,774,322 | B2 * | 8/2004 | Morinishi et al. | 200/5 R |
| 6,852,936 | B2 * | 2/2005 | Hayashi et al. | 200/61.54 |
| 7,094,980 | B2 * | 8/2006 | Ahn | 200/18 |
| 7,381,912 | B2 * | 6/2008 | Hyun et al. | 200/4 |
| 7,595,722 | B2 * | 9/2009 | Heimermann et al. | 340/461 |
| 2008/0190681 | A1 * | 8/2008 | Mayser et al. | 180/170 |

FOREIGN PATENT DOCUMENTS

JP 2001-14966 1/2001

* cited by examiner

*Primary Examiner* — Edwin A. Leon
(74) *Attorney, Agent, or Firm* — Beyer Law Group LLP

(57) ABSTRACT

An in-vehicle input device includes a housing including a supporting member; an operating knob including a shaft hole (supported part) and supported by the supporting member in such a manner that the operating knob rocks; and a switch (a moving contact of a bulge and a fixed contact of a main substrate) operated by rocking the operating knob, wherein the operating knob has a notch defining an opening intersecting with a rocking axis on a first side intersecting with the rocking axis, and wherein a rotary knob, which is an operating (second operating knob) corresponding to another switch, is disposed in the notch.

6 Claims, 7 Drawing Sheets

IN-VEHICLE INPUT DEVICE

CLAIM OF PRIORITY

This application claims benefit of Japanese Patent Application No. 2010-053396 filed on Mar. 10, 2010, which is hereby incorporated by reference.

BACKGROUND OF THE INVENTION

1. Field of the Invention

The present invention relates to an in-vehicle input device used for, for example, function selection and function control of an in-vehicle audio system and/or an in-vehicle air conditioner.

2. Description of the Related Art

An example of a known in-vehicle input device includes a device that has a rocking operating knob disposed on a spoke of a steering wheel and detects the rocking (seesaw movement) of the operating knob (for example, refer to Japanese Unexamined Patent Application Publication No. 2001-14966). In an in-vehicle input device, a storage depression accommodating the operating knob is formed in a case mounted on the spoke, and shafts provided on inner walls on opposite sides of the storage depression are engaged with shaft holes formed in the centers of side walls on both sides of the operating knob. In this way, the operating knob is supported in the case in such a manner that it rock around the central axis of the rocking, which is the straight line connecting the shafts. A circuit board provided with a plurality of switching elements is disposed on the bottom surface of the storage depression. The switching elements face the end sections of the operating knob from the back in the longitudinal direction.

In an in-vehicle input device having such a configuration, when an operator (driver) holding the steering wheel pushes one end section of the operating knob in the longitudinal direction, the operating knob rocks around the center axis to turn on a switching element. Accordingly, when items displayed on the display screen are selected on the basis of an ON signal output from the switching element, the operator can, for example, perform volume control or song selection for an in-vehicle audio system while holding the steering wheel. When the pushing force applied to the operating knob is removed, the operating knob returns to a neutral position due to a resilient force of resilient members included in the switching elements to turn off the switching elements.

SUMMARY OF THE INVENTION

In such an in-vehicle input device, an operating knob of a rocking-type switch and operating knobs of other switches such as pushing-type and turning-type switches may be disposed on a spoke of the steering wheel; for example, a rocking-type operating knob and a rotary knob, which is known as a thumb wheel, are disposed close to each other to provide multiple functions. In such a case, when the rocking-type operating knob and the rotary knob are disposed close to each other, an operator can selectively operate the rocking-type operating knob and the rotary knob with his/her thumb while holding the steering wheel. However, when two operating knobs are disposed close to each other in this way, a space large enough for the two operating knobs should be provided, and, thus, there is a problem in that it is difficult to reduce the size of the in-vehicle input device.

The present invention has been conceived in light of such problem in the related art and provides an in-vehicle input device having a reduced size even when an operating knob of rocking-type switch and an operating knob of another switch are disposed close to each other.

Accordingly, the in-vehicle input device according to the present invention includes a housing including a supporting member; a first operating knob including a supported part and supported by the supporting member in such a manner that the first operating knob rocks; and a switch operated by rocking the first operating knob, wherein the first operating knob has a notch defining an opening intersecting with a rocking axis on a first side intersecting with the rocking axis, and wherein a second operating knob corresponding to another switch is disposed in the notch.

With an in-vehicle input device having such a configuration, the notch opening to a side of the first operating knob can be efficiently used as a space in which the second operating knob is disposed. Consequently, the space efficiency is increased, and the size of the entire device can be reduced even when the operating knob of the rocking-type switch and the operating knob of another switch are disposed close to each other. To operate the first operating knob, the parts on both sides of the notch in the first operating knob may be operated with a finger, and to operate the second operating knob, the finger may be moved near the notch. Since the finger is moved by a small distance, operability can be improved.

In the configuration described above, it is desirable that the housing have a guiding member guiding the first operating knob in such a manner that the first operating knob rocks near a section on at least one of two sides of the notch in the first operating knob, and the first operating knob have a guided part engaging with the guiding member. This is desirable because the distance between the guiding members and the supporting members in the rocking axis direction or the distance between the guided parts and the supported parts can be set large, and consequently, the backlash of the first operating knob generated during operation can be efficiently suppressed, and the operating touch is improved by stabilizing the rocking of the first operating knob.

In the configuration described above, it is desirable that one of the guiding member and the guided part have a depression, and the other have a protrusion engaging with the depression because the rocking of the first operating knob is stabilized by a simple configuration.

In the configuration described above, it is desirable that another first operating knob be provided and positioned such that the notches of the two first operating knobs face each other, and the second operating knob be disposed inside the notches. This is desirable because the operator can selectively operate one of operating knobs by slightly moving his/her finger, and thus, an in-vehicle input device having excellent operability can be realized. This is extremely desirable since two first operating knobs and one second operating knob can be intensively disposed.

In this case, when the second operating knob comprises a rotary knob, and the rotation axis of the rotary knob intersects with the first side of the first operating knob, the movement of the finger rocking the first operating knobs and the movement of the finger turning the second operating knob partly overlap. Therefore, the in-vehicle input device has excellent operability.

DESCRIPTION OF THE PREFERRED EMBODIMENTS

Figure 1:
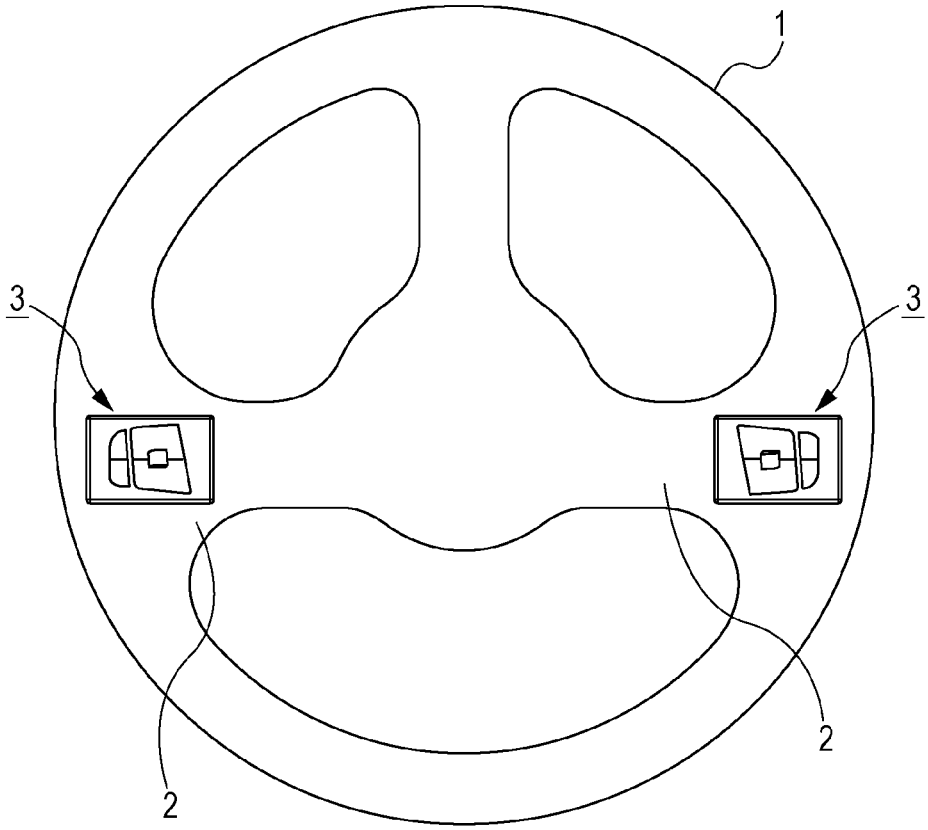
FIG. 1 is a plan view of a steering wheel on which an in-vehicle input device according to an embodiment of the present invention is attached.

As illustrated in FIG. 1, in-vehicle input devices 3 according to this embodiment are attached to left and right spokes 2 of a steering wheel 1. Since the two in-vehicle input devices 3 have the same configuration, the in-vehicle input device 3 on the left in FIG. 1 (see FIG. 2) will be described in detail below.

Figure 3:
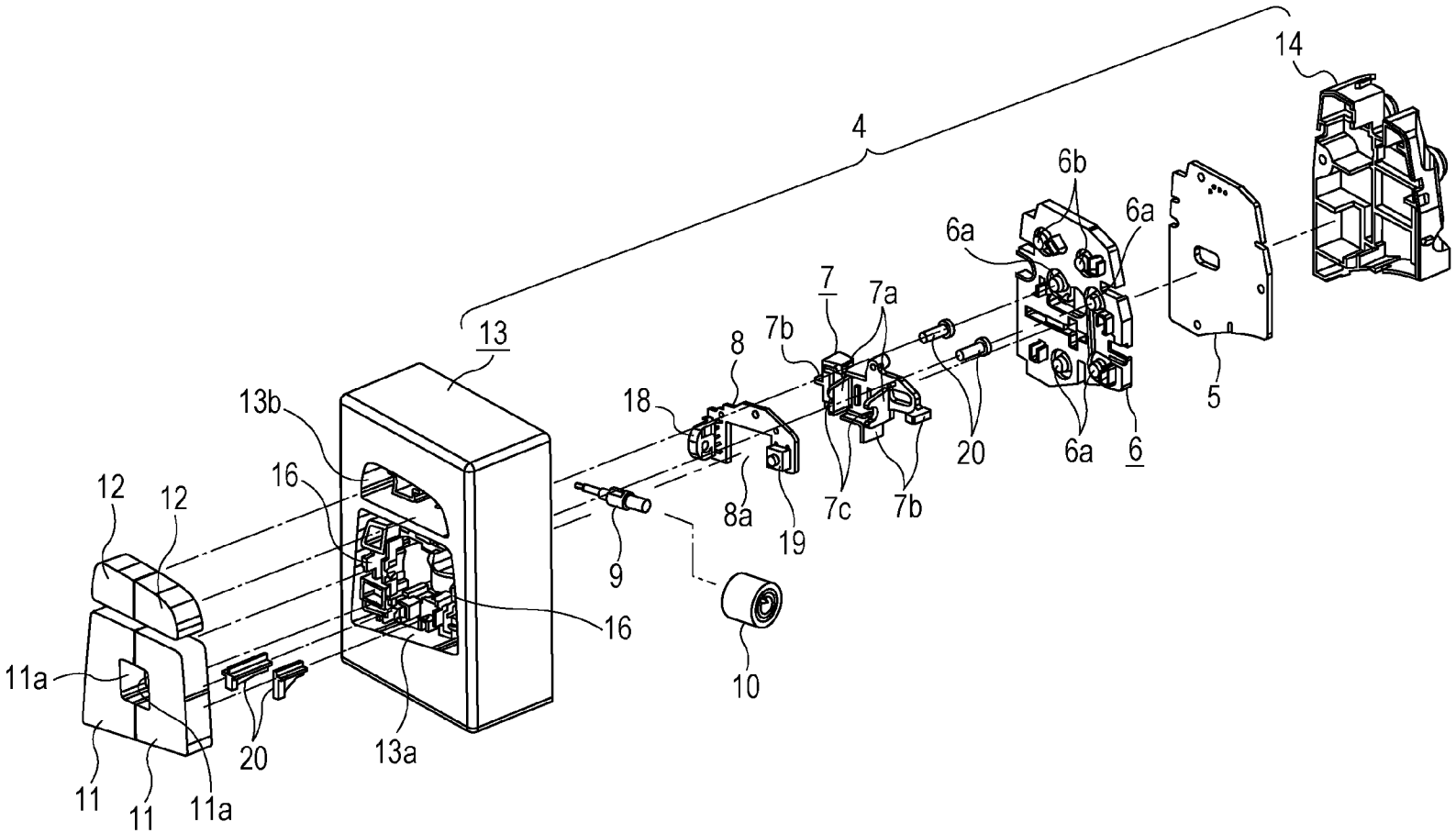
FIG. 3 is an exploded perspective view of the in-vehicle input device illustrated in FIG. 2.

As illustrated in FIG. 3, the in-vehicle input device 3 according to this embodiment includes a housing 4 secured inside a depression in the spoke 2, a main substrate 5 disposed inside the housing 4, a rubber sheet 6 disposed on the main substrate 5, a support 7 disposed on the rubber sheet 6, a sub-substrate 8 secured to the support 7, a rotary knob 10, which is a second operating knob, rotatably supported by the support 7, paired operating knobs 11, which are rocking-type first operating knobs, surrounding the rotary knob 10, and paired operating keys 12 adjoining the operating knobs 11. The in-vehicle input device 3 is used for, for example, function selection and function control for an in-vehicle audio system and an in-vehicle air conditioner. In the in-vehicle input device 3, the rotary knob 10 can be turned and pushed, the operating knobs 11 can be rocked, and the operating keys 12 can be pushed by the finger of the operator (driver) holding the steering wheel 1.

Figure 4:
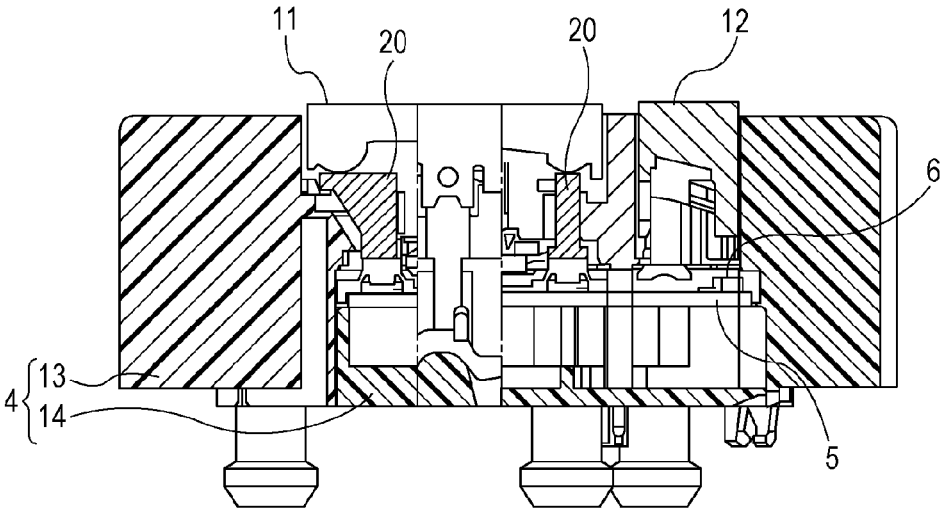
FIG. 4 is a sectional view taken along line IV-IV in FIG. 2.
Figure 5:
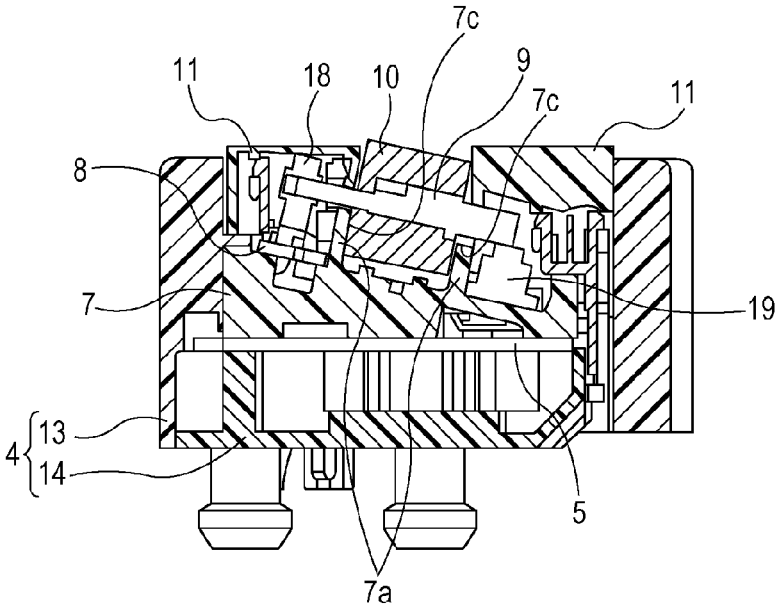
FIG. 5 is a sectional view taken along line V-V in FIG. 2.

As illustrated in FIGS. 4 and 5, the housing 4 is an integrated unit formed by snap-fitting an upper case 13 and a lower case 14, which are made of synthetic resin. The upper case 13 is shaped as a box with an opening at the bottom (lower side in the drawing). The bottom of the upper case 13 is covered with the lower case 14. As illustrated in FIG. 3, two depressions 13*a* and 13*b* of different sizes are formed in the front of the upper case 13. The larger depression 13*a* accommodates the rotary knob 10 and the operating knobs 11, and the smaller depression 13*b* accommodates the operating keys 12.

Figure 7:
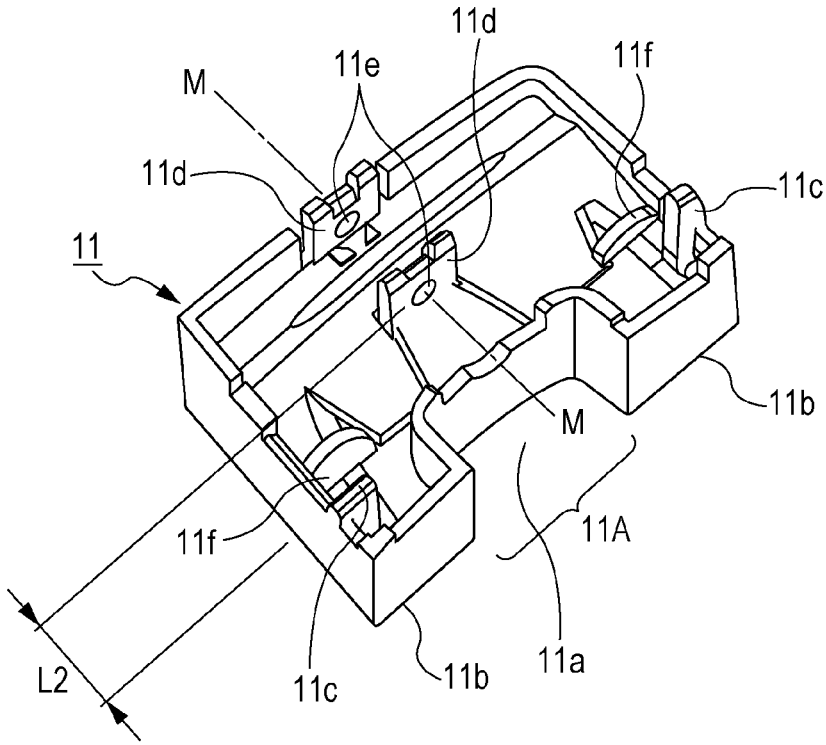
FIG. 7 is a perspective view from the back of the operating knob illustrated in FIG. 6.
Figure 8:
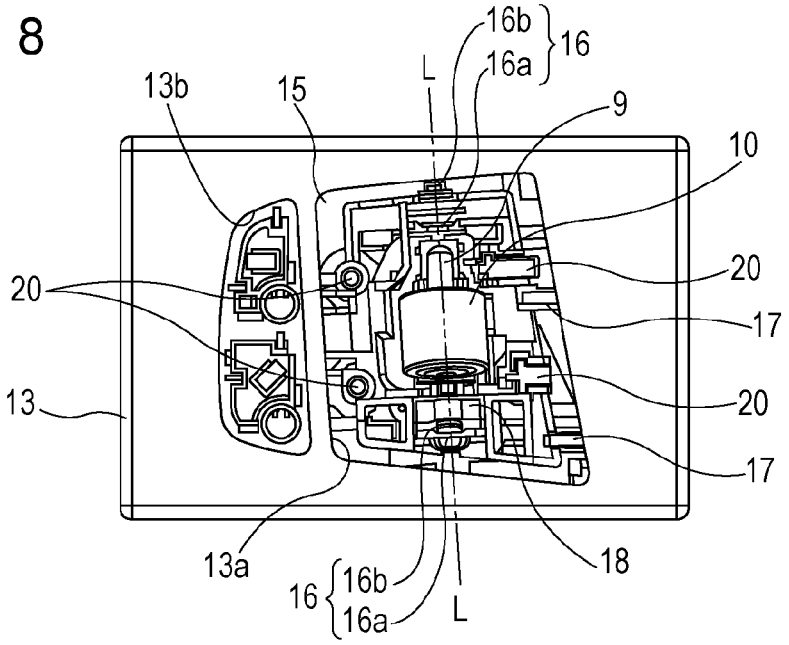
FIG. 8 is a plan view of the in-vehicle input device illustrated in FIG. 2 with the operating knob, etc. removed.
Figure 9:
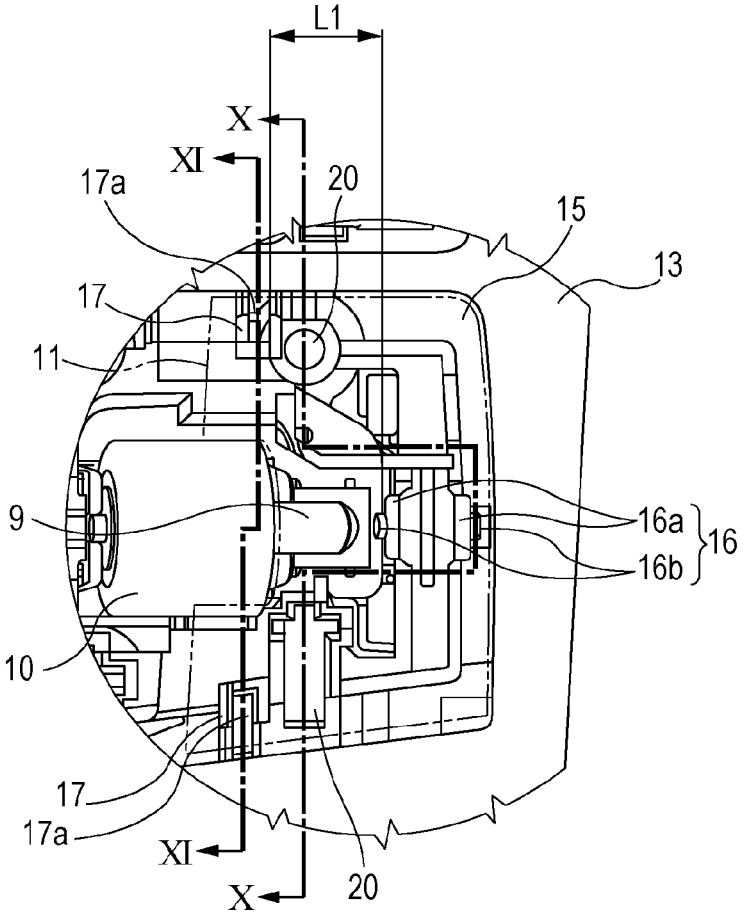
FIG. 9 is a plan view of the essential parts in FIG. 8.

As illustrated in FIGS. 8 and 9, a vertically disposed partition 15 is integrated in the inner edge part of the depression 13*a* on the inner bottom surface of the depression 13*a* of the upper case 13. The partition 15 has two supporting members 16 and four guiding members 17. Each of the supporting members 16 includes supporting plates 16*a* and bosses 16*b* protruding outward from the ends of the supporting plates 16*a* (see FIG. 9). The bosses 16*b* are engaged with shaft holes 11*e* (see FIG. 7) formed in protruding plates 11*d*, which are described below. Among the four inner edges of the depression 13*a*, the two edges intersecting with the rotation axis L-L of the rotary knob 10 (represented by the chain double-dashed line in FIG. 8) are referred to as first and second sides, and the remaining two edges are referred to as third and fourth sides. The supporting members 16 are disposed near the first and second sides. As illustrated in FIG. 9, each of the guiding members 17 is a column having a depressed transverse section and has a depression 17*a*. The depression 17*a* engages with a guided part 11*c* (see FIGS. 6 and 7), which is described below. As illustrated in FIG. 8, two pairs of the guiding members 17, i.e., four guiding members 17, are provided. The paired guiding members 17 are disposed near the third and fourth sides.

As illustrated in FIG. 3, the rubber sheet 6 has a plurality of bulges 6*a* and 6*b* (six bulges in this embodiment). Moving contacts (not shown) are disposed on the inner bottom surfaces of the bulges 6*a* and 6*b*. Fixed contacts (not shown) that oppose and move in and out of contact with the moving contacts are disposed on the upper surface of the main substrate 5. Each of the pairs of moving contacts and fixed contacts constitute a switch; for example, the four bulges 6*a* and the corresponding fixed contacts constitute switches for the operating knobs 11. Furthermore, the two bulges 6*b* and the corresponding fixed contacts constitute switches for the operating keys 12. Instead of such switches, a plurality of push switches including moving contacts and fixed contacts may be disposed on the main substrate 5.

The support 7 illustrated in FIG. 3 is molded from synthetic resin. Paired vertical walls 7*a* extending toward the upper case 13 are disposed on the support 7 a predetermined distance apart from each other. Protruding pieces 7*b* protruding toward the upper case 13 are disposed on the circumference of the support 7. By positioning the protruding pieces 7*b* by inserting them into grooves (not shown) in the inner surface of the upper case 13, the support 7 is securely clamped between the upper case 13 and the rubber sheet 6. The sub-substrate 8 is secured to the support 7, and the vertical walls 7*a* of the support 7 protrude through a notch 8*a* in the sub-substrate 8. A rotary encoder 18 and a push switch 19, which are additional switches, are disposed on the upper surface of the sub-substrate 8. The rotary encoder 18 and the push switch 19 are disposed on the outer side of the vertical walls 7*a*.

As illustrated in FIGS. 3 and 5, a shaft 9 is engaged with a center hole in the rotary knob 10. The parts of the shaft 9 protruding from opposite sides of the rotary knob 10 are rotatably supported by shaft-receiving depressions 7*c* formed in the upper edges of the vertical walls 7*a*. A first end of the shaft 9 is engaged with a rotor member of the rotary encoder 18 such that the turning force applied to the rotary knob 10 is transmitted to the rotary encoder 18 via the shaft 9. A second end of the shaft 9 is disposed such that the push switch 19 can be driven by pushing. The pushing force applied to the rotary knob 10 is transmitted to the push switch 19 via the shaft 9. As illustrated in FIG. 5, the axis of the shaft 9 (rotation axis L-L of the rotary knob 10) and the sub-substrate 8 are tilted with respect to the main substrate 5. Instead, they may be parallel to the main substrate 5. The axis of the shaft 9 and the rocking axis of the operating knobs 11 are aligned with the rotation axis L-L in FIG. 8 when viewed from the top. Instead, they may be parallel to the rotation axis L-L when viewed from the top.

Figure 2:
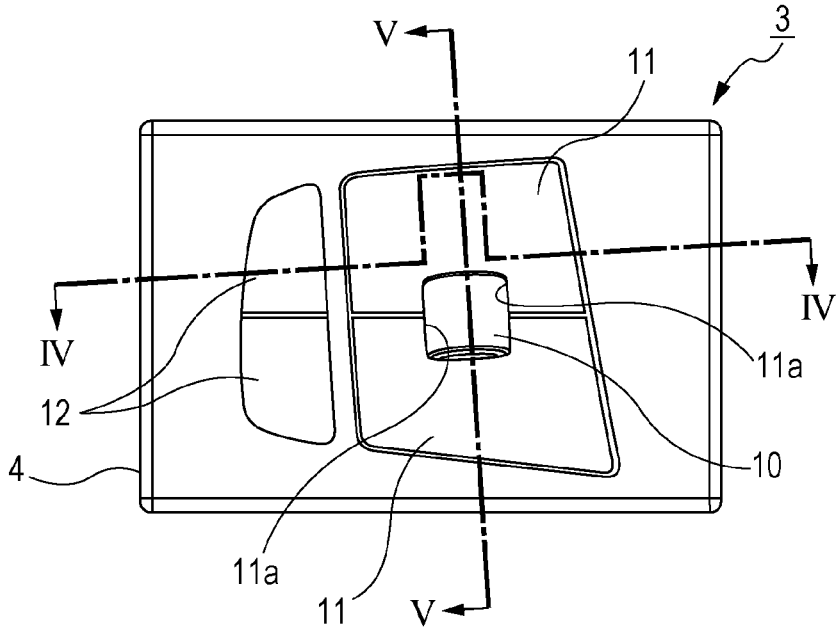
FIG. 2 is a plan view of the in-vehicle input device illustrated in FIG. 1.
Figure 6:
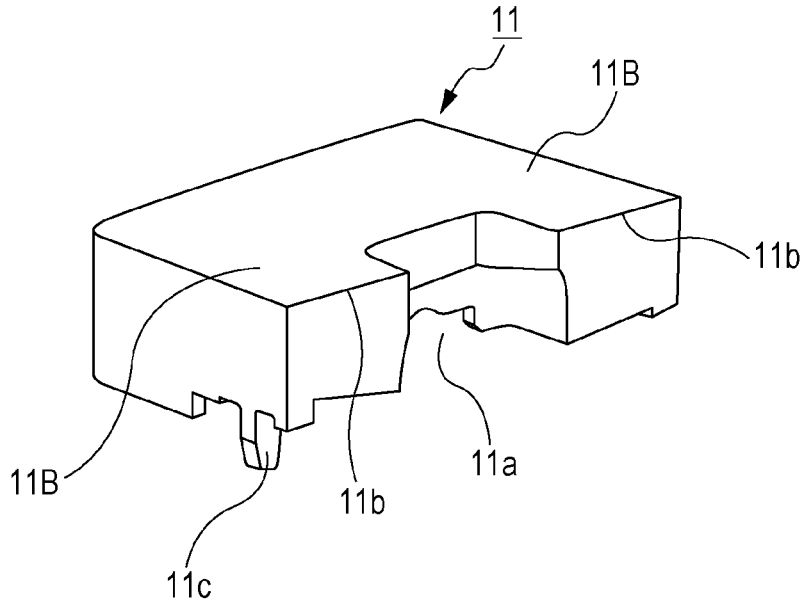
FIG. 6 is a perspective view of an operating knob included in the in-vehicle input device illustrated in FIG. 1.

As illustrated in FIG. 2, the two operating knobs 11 disposed side by side are molded from synthetic resin. Each of the operating knobs 11 has a rectangular notch 11*a* defining an opening 11A on one side. The operating knobs 11 are positioned such that the notches 11*a* face each other. Among the two operating knobs 11, the operating knob 11 that is disposed on the top in FIG. 2 will be described below. As illustrated in FIGS. 6 and 7, the operating knob 11 has the notch 11*a* defining the opening 11A that intersects the rocking axis of the operating knob 11 on the a side 11*b*, which intersects (e.g., orthogonal with) a straight line M-M passing through the shaft holes 11*e* (supported parts) of the paired protruding plates 11*d* protruding from the back side of the operating knob 11. On the back side of the operating knob 11, pushing protrusions 11*f* that contact driving rods 20 (which may have different shapes but the same function), which are described below, are provided. In the operating knob 11, the guided parts 11*c* protrude from sections on both sides of the notch 11*a*, which is non-notch parts 11B (see FIG. 6) where the notch 11*a* is not formed, i.e., near the sections that oppose the inner edge of the depression 13*a* of the housing 4. Each of the guided parts 11*c* is a protruding rib and is engaged with the corresponding depression 17*a* of the guiding members 17 disposed on the upper case 13. By inserting the bosses 16*b* of the paired supporting members 16 of the upper case 13, which are illustrated in FIG. 9, into the shaft holes 11*e* in the operating knob 11, the operating knob 11 is supported on the supporting members 16 in such a manner that it rocks. With such a configuration, the distance L1 between the guiding members 17 and the supporting members 16 (see FIG. 9) in the rocking axis direction or the distance L2 between the guided parts 11*c* and the shaft holes (supported parts) 11*e* (see FIG. 7) can be set large; consequently, the backlash of the operating knob 11 generated during operation can be efficiently suppressed, and the operating touch is improved by stabilizing the rocking of the operating knob 11.

The other operating knob 11 disposed on the bottom in FIG. 2 basically has the same configuration as the operating knob 11 described above. A rectangular space in plan view is defined by the notches 11*a* of the operating knobs 11, and the rotary knob 10 is positioned in this space.

Figure 10:
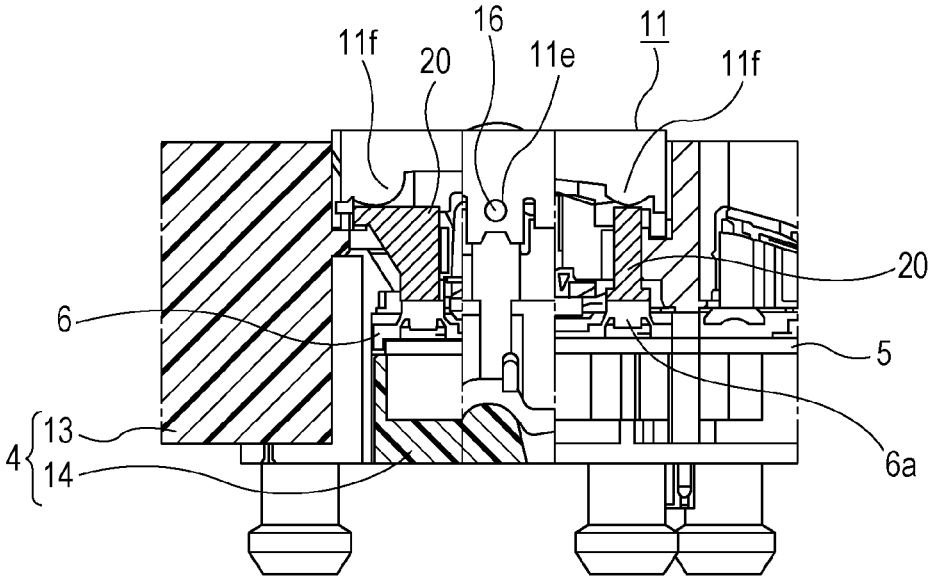
FIG. 10 is a sectional view taken along line X-X in FIG. 9.
Figure 11:
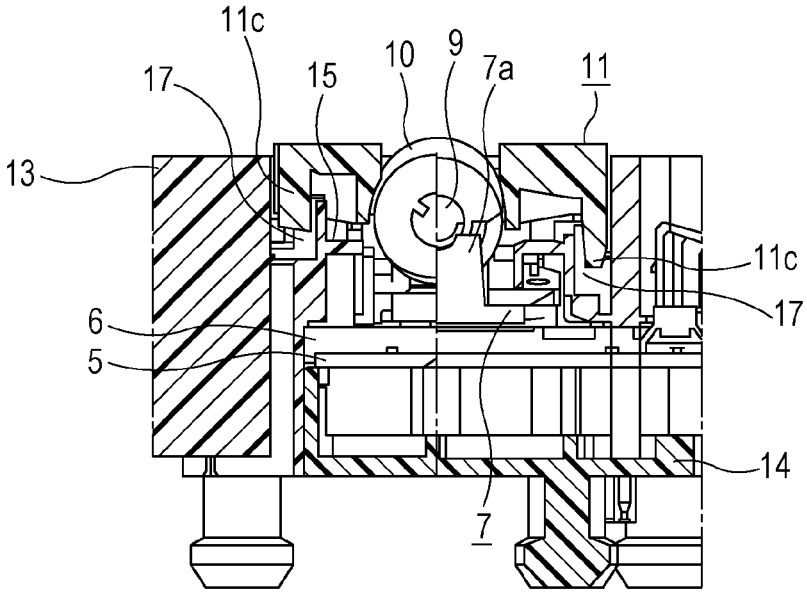
FIG. 11 is a sectional view taken along line XI-XI in FIG. 9.

In FIG. 10, a total of four driving rods 20 (two for each operating knob 11) are disposed on the lower section of the operating knobs 11. The driving rods 20 are supported by the partition 15 formed at the depression 13*a* of the upper case 13 in such a manner that they vertically move. The upper ends of driving rods 20 contact the pushing protrusions 11*f* of the operating knob 11. By mounting the driving rods 20 on the bulges 6*a* of the rubber sheet 6, the operating knob 11 receives a resilient force from the paired bulges 6*a* and is maintained at a neutral position (non-operating position). Driving rods (not shown) are integrated in the paired operating keys 12 disposed in the depression 13*b* of the upper case 13 and are supported on the upper case 13 in such a manner that they vertically move. By mounting the driving rods on the bulges 6*b* of the rubber sheet 6, the operating key 12 receive the resilient force from the bulges 6*b* and is maintained at a neutral position (non-operating position).

In the in-vehicle input device 3 having such a configuration, when the operator (driver) holding the steering wheel 1 pushes one of the operating keys 12 using his/her finger, the corresponding bulge 6*b* of the lower rubber sheet 6 receives the pushing force and undergoes buckling distortion; consequently, the moving contact disposed on the inner bottom surface of the bulge 6*b* contacts the corresponding fixed contact of the main substrate 5, and the switch positioned right below pushed operating key 12 turns on. When the pushing force applied to the operating key 12 is removed, the bulge 6*b* that had undergone buckling distortion automatically restores its original state (non-operating state); consequently, the switch that has been turned on is turned off, causing the operating key 12 to automatically return to the original position.

When the operator pushes the top surface of one of the operating knobs 11, this operating knob 11 rocks along the center axis, which is the straight line M-M connecting the shaft holes 11*e* of the operating knob 11 (see FIG. 7), and the driving rod 20 positioned in the rocking direction pushes down the bulge 6*a* right below. As a result, the bulge 6*a* undergoes buckling distortion, causing the moving contact to contact the fixed contact on the main substrate 5 and to turn on. When the rocking force applied to the operating knob 11 is removed, the bulge 6*a* that had undergone buckling distortion automatically restores its original state (non-operating state); consequently, the switch element that has been turned on is turned off, causing the operating knob 11 to automatically return to its original neutral position.

When the operator turns the rotary knob 10 around the axis of the shaft 9, the applied turning force is transmitted to the rotor part of the rotary encoder 18 via the shaft 9; consequently, a detection signal corresponding to the amount of turning is output from the rotary encoder 18. When the operator pushes the rotary knob 10, the shaft 9 is tilted at the end on the side of the rotary encoder 18 to push the driving part of the push switch 19. As a result, the push switch 19 is turned on. When the pushing force applied to the rotary knob 10 is removed, the original state is automatically restored by the resilient force of a return spring (not shown) in the push switch 19 such that the push switch 19, which has been turned on, is turned off, and the shaft 9 automatically returns to its original position.

As described above, the in-vehicle input device 3 according to this embodiment includes the housing 4 including the supporting members 16; the operating knob 11 including the shaft holes 11*e* (supported parts) and supported by the supporting members 16 in such a manner that it rocks; and a switch operated by rocking the operating knob 11 (the moving contacts of the bulges 6*a* and the fixed contacts on the main substrate 5), wherein the operating knob 11 has notches 11*a* defining the opening 11A intersecting with the rocking axis (straight line M-M in FIG. 7) on the side 11*b* intersecting with the rocking axis M-M, and wherein the rotary knob 10, which is an operating knob corresponding to another switch (second operating knob), is disposed in the notches 11*a*. Therefore, the notches 11*a* can be efficiently used as a space to accommodate the rotary knob 10, improving the space efficiency and reducing the size of the entire device. To operate the operating knob 11, both sides of the notches 11*a* in the operating knob 11 may be pushed with a finger, and to operate the rotary knob 10, the rotary knob 10 disposed in the notches 11*a* may be turned with a finger. Since the operating knob 11 and the rotary knob 10 can be operated by placing and moving the finger near the notches 11*a* and since the operation can be carried out by moving the finger by a short distance, operability is improved.

In the housing 4, the guiding members 17 guiding the operating knobs 11 in such a manner that the operating knobs rock are disposed in an area adjoining at least one side (11B) of the two sides of the notches 11*a* of the operating knobs 11, which is represented by the chain double-dashed line in FIG. 9, and the guided parts 11*c* engaging with the guiding members 17 are disposed on the operating knobs 11. Accordingly, the distance L1 (see FIG. 9) between the guiding members 17 and the supporting members 16 in the rocking axis (straight line M-M in FIG. 7) direction or the distance L2 (see FIG. 7) between the guided parts 11*c* and the shaft holes (supported parts) 11*e* can be set large; consequently, the backlash of the operating knob 11 generated during operation can be efficiently suppressed, and the operating touch is improved by stabilizing the rocking of the operating knob 11.

In the in-vehicle input device 3, since the paired operating knobs 11 are disposed in parallel such that the notches 11*a* face each other, and the rotary knob 10, which is another operating knob, is disposed inside the notches 11*a*, two rocking-type operating knobs 11 and one rotating-type rotary knob 10 can be disposed intensively, and the size of the in-vehicle input device 3 can be reduced without interfering with the operability.

Since the rotation axis of the rotary knob 10 intersect with the sides 11*b* of the operating knobs 11, the movement of the finger rocking the operating knob 11 and the movement of the finger turning the rotary knob 10 partly overlap. Therefore, the in-vehicle input device 3 has excellent operability.

In the embodiment described above, the guiding members 17 are disposed near the inner edges of the depression 13*a* opposing both sides of the notches 11*a* in the operating knob 11 in the housing 4, and the guided parts 11*c* corresponding to the guiding members 17 are disposed on the operating knob 11. Instead, however, the guiding members 17 may be disposed only on only of the sides of the notches 11*a*, and the guided part 11*c* may correspond to the guiding members 17 provided in such manner. The shapes of the guiding members 17 and the guided parts 11*c* are not limited to those according to the embodiment described above, and instead, the protrusion and depression of the guiding members 17 and the guided parts 11*c* may be reversed such that the guiding members 17 are protruding ribs and the guided parts 11*c* are columns having a depressed transverse section.

In the embodiment described above, the rotary knob 10 is disposed inside the notches 11*a* in the paired operating knob 11 disposed in parallel. Instead, the rotary knob 10 may be disposed inside the notch 11*a* in a single operating knob 11. Instead of such a rotating-type rotary knob 10, another type of operating knobs, such as a pushing-type or a rocking-type, may be disposed.

What is claimed is:

1. An in-vehicle input device comprising:

a housing including:

a supporting member having a pair of bosses; and a guiding member;

a first operating knob supported by the supporting member and guided by the guiding member in such a manner that the first operating knob rocks around a rocking axis, the first operating knob including:

a supported part having a pair of protruding plates each having a hole provided therethrough, the hole receiving corresponding one of the pair of bosses of the support member;

a guided part engaging with the guiding member; and a notch provided on a first side of the first operating knob and intersecting with the rocking axis, the guiding member being provided in a vicinity of at least one side of the notch;

a switch operated by rocking the first operating knob; and a second operating knob corresponding to another switch, the second knob being disposed in an opening defined by the notch.

2. The in-vehicle input device according to claim 1, wherein one of the guiding member and the guided part has a depression, and the other has a protrusion engaging with the depression.

3. The in-vehicle input device according to claim 2, wherein another first operating knob is provided and positioned such that the notches of the two first operating knobs face each other, and wherein the second operating knob is disposed inside the notches.

4. The in-vehicle input device according to claim 3, wherein the second operating knob comprises a rotary knob, and wherein a rotation axis of the rotary knob intersects with the first side of the first operating knob.

5. The in-vehicle input device according to claim 1, wherein the guided part is provided in a vicinity of the first side of the first operating knob and the supported part is provided in a vicinity of a second side of the first operating knob opposite to the first side.

6. The in-vehicle input device according to claim 1, wherein the second operating knob includes a rotary knob rotating around a rotation axis, and wherein the supporting member is provided in a vicinity of a first side of the housing intersecting with the rotation axis, and the guiding member is provided in a vicinity of a second side of the housing not intersecting with the rotation axis.

* * * * *